US006209239B1

(12) United States Patent
Archer et al.

(10) Patent No.: US 6,209,239 B1
(45) Date of Patent: Apr. 3, 2001

(54) STEAM IRON AND METHOD OF MANUFACTURE OF THE STEAM CHAMBER

(75) Inventors: Dorian O. Archer, Richmond; Farhad Moalem, Alexandria; Ramon R. Rodriguez, Richmond, all of VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 0 days.

(21) Appl. No.: 09/388,012

(22) Filed: Sep. 1, 1999

(51) Int. Cl.[7] ..... D06F 75/18
(52) U.S. Cl. ..... 38/77.83
(58) Field of Search ..... 38/88, 77.83, 77.8, 38/77.82; 219/245, 248, 250, 256, 258

(56) References Cited

U.S. PATENT DOCUMENTS 4,523,079 * 6/1985 Albinger, Jr. ..... 38/77.83 X
4,536,641 * 8/1985 Chan ..... 38/77.83 X
4,658,520 * 4/1987 Henneberger et al. ..... 38/77.83 X
4,711,010 * 12/1987 Walter ..... 38/77.83 X
5,079,823 * 1/1992 Walter et al. ..... 38/88 X
5,615,500 * 4/1997 Moalem et al. ..... 38/77.83
5,715,617 * 2/1998 Ros ..... 38/77.83
5,718,071 * 2/1998 Zbriger ..... 38/77.83
5,979,089 * 11/1999 Bouleau et al. ..... 38/77.83

* cited by examiner

*Primary Examiner*—Ismael Izaguirre
(74) *Attorney, Agent, or Firm*—Roger S. Dybvig

(57) ABSTRACT

To prevent water particles or mist carried by steam exiting from the steam vents of a steam iron, the steam generated in its steam chamber follows tortuous paths from both a vaporization section and a blast path to the steam vents. A baffle having a concave front face spans across the rear of the vaporization section and the open rear ends of the blast path face the concave baffle face. The lid of the steam chamber is sealed by pressure to the baffle and to a pair of ribs that define the sides of the blast path. The outer rib is higher than the inner rib so that, if the seal between the lid fails, the failure will likely occur between the inner rib and the lid so that any water escaping from the blast path will likely enter the vaporization chamber and not exit through a steam vent.

10 Claims, 5 Drawing Sheets

30
26
24
48
66
10
22
64
18
20
36
34
28
38
21
40
46
44
42
100
16
98
75
32
35
86
75
75
12
88
96
14

STEAM IRON AND METHOD OF MANUFACTURE OF THE STEAM CHAMBER

FIELD OF THE INVENTION

This invention relates generally to a steam iron and a method of manufacturing the same. This invention is primarily concerned with household steam irons but aspects of the invention may be useful in other applications.

BACKGROUND OF THE INVENTION

Steam irons commonly have a soleplate comprising a metal casting having insert-molded heating elements extending through the casting, typically along a generally U-shaped path parallel to the bottom of the soleplate. A portion of the top the soleplate is covered by a sheet metal lid to form a steam chamber. The steam chamber is typically divided into a vaporization section, a blast path, and a steam vent section. The steam vent section may be divided into two or more subsections which may or may not be in open communication with one another. The vaporization section is located within the area between the legs of the U-shaped path of the heating element. Steam is produced during the normal course of operation by water dripped into the vaporization section onto a heated, upwardly-facing surface of the soleplate. The water is heated as it flows along the upper surface of the soleplate and converted into steam. The steam thus produced exits from the vaporization section into the steam vent sections through tortuous steam channels formed by surfaces included in the design of the soleplate. Plural steam outlet vents in the steam vent section permit steam to exit from the bottom of the soleplate onto the fabric or other material being pressed by the steam iron.

The steam blast path is located directly above, or almost directly above, an elongate portion of the heating element. Steam created along the blast path usually enters the steam vent sections through the same tortuous channels, or a portion of such channels, along which steam formed in the vaporization section passes.

A pair of ribs, namely an outer rib and an inner rib define the sides of a blast path. The ribs are ordinarily covered and sealed by the steam chamber lid. If the seal between the outer rib of the blast path and the chamber lid fail, water or water vapor from the blast path could escape the blast path and enter directly into the steam vent section. As result, water could exit the steam vent and cause undesirable "trailing" of streaks of water on the material being pressed. Trailing can also occur if water which has not been entirely vaporized into steam, either in the vaporization section or along the blast path, is permitted to enter the steam vent sections through the steam channels which are intended to direct only steam into the steam vent sections.

SUMMARY OF THE INVENTION

This invention provides an improved steam chamber for a steam iron and a method of manufacturing the improved steam chamber.

A primary object of this invention is to provide manufacturing methods and steam iron constructions for reducing trailing caused by the passage of water from the steam vents of a steam iron.

A more specific object of this invention is to prevent water particles or mist carried by steam exiting from the outlet of either the vaporization section or the blast path from entering into the steam vent section. In addition to providing a tortuous path through which the steam must flow in order to enter the steam vent section, in accordance with this invention a baffle is located at the rear of the steam chamber. The baffle has a concave front face spanning across substantially the entire rearward end of the vaporization section. The baffle functions in a manner analogous to a concave mirror, with regard to the blast path, tending to direct vapor toward the center and the front of the vaporization section. The baffle also functions, with respect to the vaporization section and the blast path, to keep water particles not completely vaporized from entering into the steam vent sections. Water particles striking the baffle will tend to accumulate and puddle in front of the baffle. Advantageously, the blast path has rearwardly facing openings that tend to direct vapor exiting from the blast path toward the baffle. Accordingly, whether the source of any water particles that have not been completely vaporized in the vaporization section or the blast path, the water will be confined in front of the baffle and be restrained from entering into the steam vent sections.

Another more specific object of this invention is to provide an improved seal between the steam chamber lid and the ribs that define the sides of the blast path. In accordance with this aspect of the invention, the inner and outer ribs forming the sides of the blast path are at different heights, the inner rib being slightly lower than the outer rib, and, during manufacture, the steam chamber lid is pressed onto the inner and outer ribs with sufficient force that the lid is sealed to the tops of both the inner and the outer ribs. Rivets are provided to help maintain the seals between the lids and the inner and outer ribs. If a failure in the sealing of the lid to the ribs should occur, the failure is most likely to occur between the lid and the inner rib because the inner rib has a height lower than the outer rib. Upon the occurrence of such a failure, water may extend over the inner wall into the vaporization section but will not extend over the outer wall into the steam vent section. Water entering the vaporization section will most probably be completely vaporized into steam or else be confined to an area in front of the rear baffle, as described above, so that the failure of the seal between the inner rib and the lid will not lead to a trailing problem.

In another aspect of this invention, an object is to improve the response of a canister type thermal cut off device (TCO) to prevent an excessive thermal runaway of an iron. It is conventional to locate a TCO between the soleplate and the base cover of a steam iron. This invention follows such conventional practice and, in addition, provides a base cover having a dome in which the TCO is located. Accordingly, the TCO has a substantial volume of air surrounding it within which heat can be retained so that a thermal build-up is sensed more rapidly than if the TCO were closely confined between the soleplate and the base cover.

Other objects and advantages will become apparent from the following description and the drawings.

DETAILED DESCRIPTION

Figure 1:
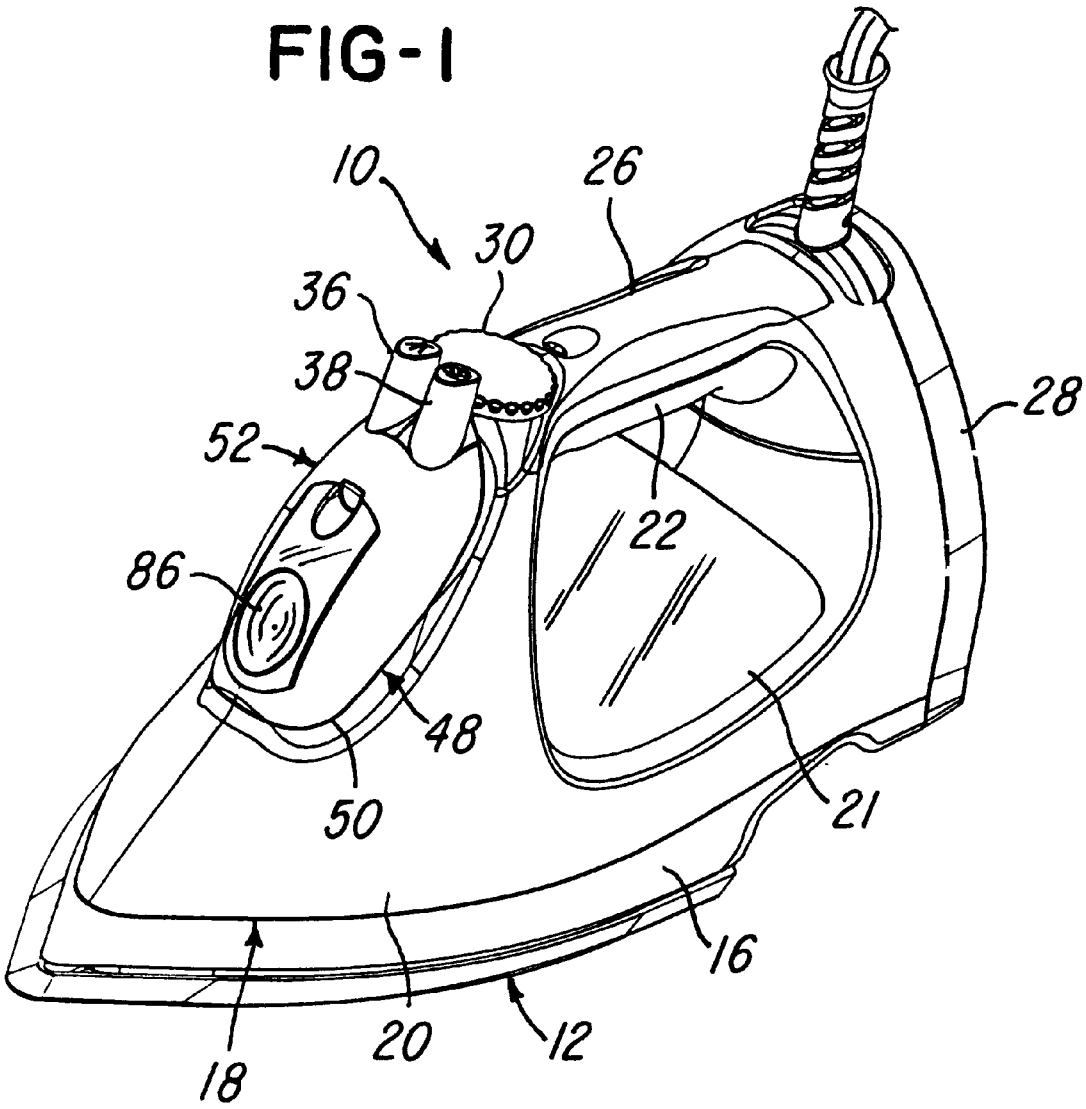
FIG. 1 is a perspective view of a steam iron made in accordance with this invention.
Figure 2:
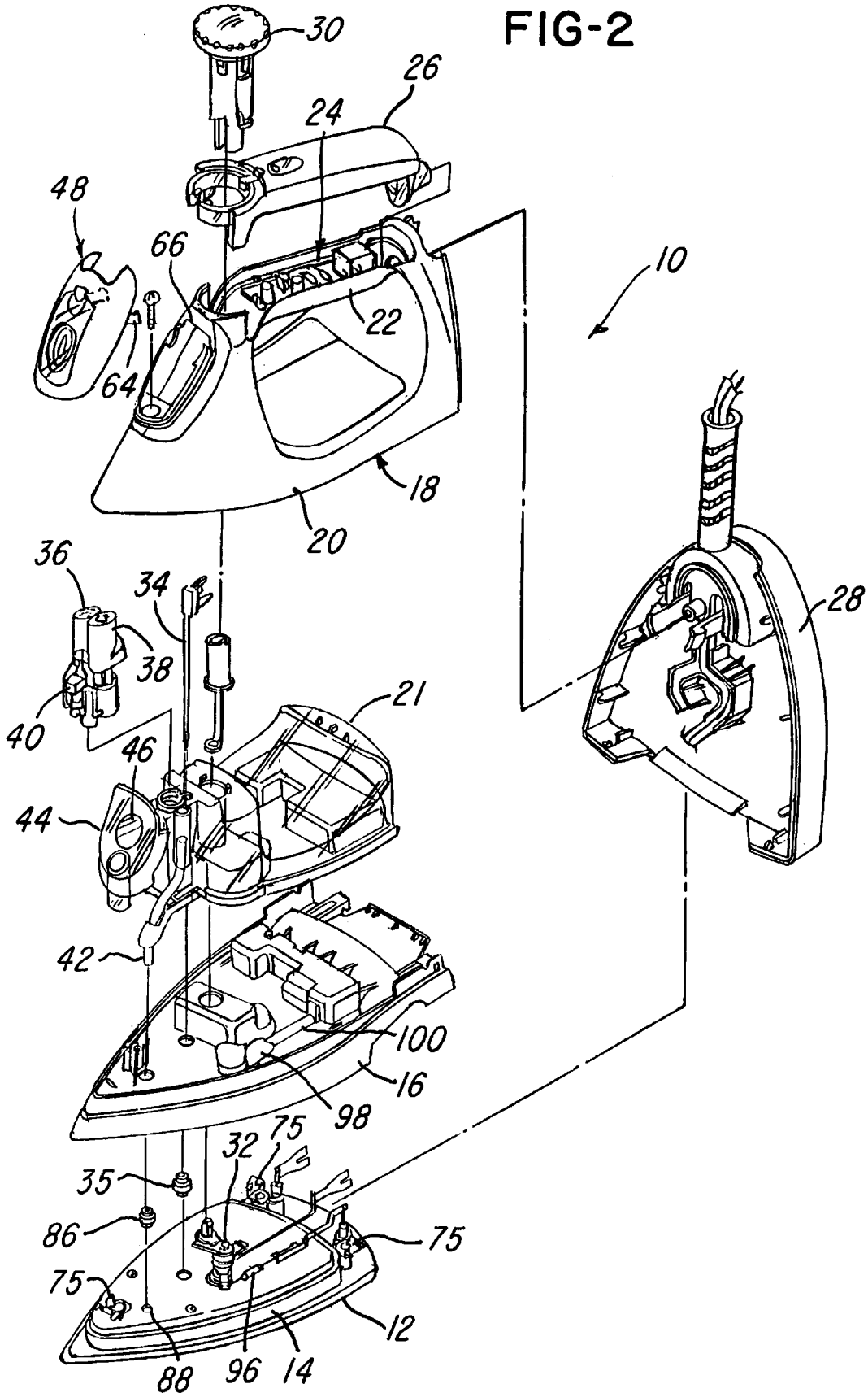
FIG. 2 is an exploded isometric view of the iron of FIG. 1.
Figure 3:
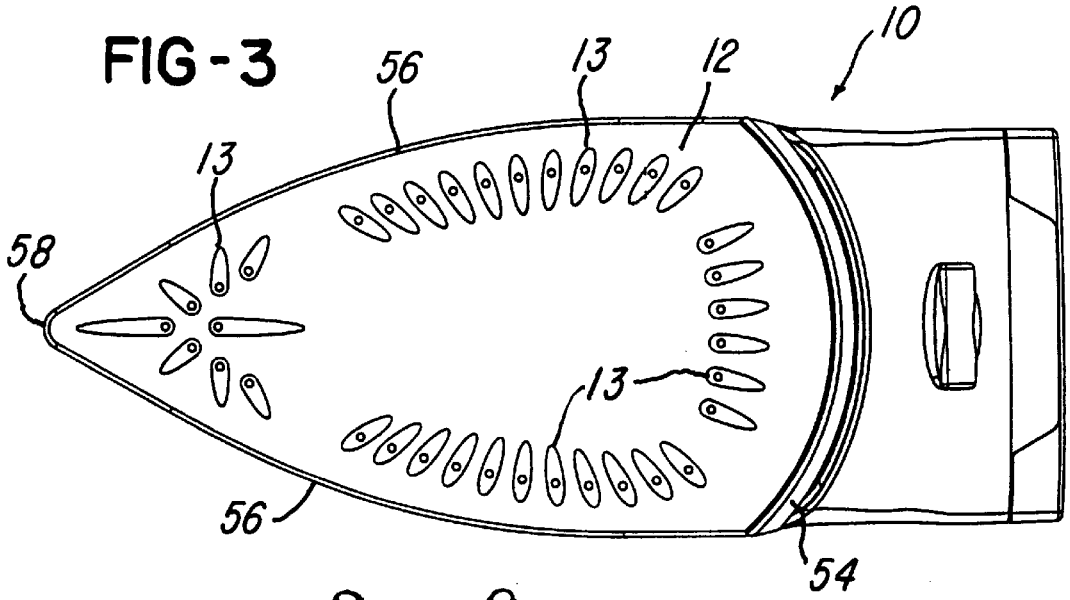
FIG. 3 is a bottom plan view of the iron of FIG. 1.

With reference to FIGS. 1 and 2, the present invention is illustrated in connection with a household steam iron, generally designated 10, having a soleplate 12 with a steam chamber 14, covered by a base cover 16 which supports a handle 18. Handle 18 has a lower portion 20 which confines a water reservoir 21 and an upper portion 22 which receives an electronic control module 24 and which is covered by a top cover 26. The handle upper portion 22 and the top cover 26 constitute a handgrip. In addition, the iron 10 includes a rear cover 28, a temperature control knob 30 for setting a thermostat 32 mounted on the soleplate 12, and a drip valve assembly including a drip valve stem 34 for dripping controlled quantities of water into the steam chamber 14 through a drip valve seal 35. As well known, the water dripped into the steam chamber 14 is heated by a U-shaped electrical heating element 15 (FIGS. 4 and 6) in the soleplate 12, vaporizes and forms steam which exits from the soleplate 12 through plural steam vents 13 (FIGS. 3 and 5). Terminals 15A of the heating element 15 and the electronic controls are connected to house current by means of a power cord connected to the rear cover 28. The particular iron 10 shown in the drawings also has a pair of manually-operable pistons 36 and 38, respectively used to spray water forwardly of the iron through a nozzle 40 and to create a burst of steam by pumping water by way of a thermoplastic tube connection 42 into the steam chamber 14. The water reservoir 21 has a forwardly projecting front face 44 and a water conduit 46 extending through the front face 44 into the hollow interior of the reservoir 21. A fill port assembly, generally designated 48, is used to enable one to pour water into the water reservoir 21 and also to cover the water conduit 46 during normal use of the iron to prevent contaminants from entering into the reservoir 21.

Referring now to FIGS. 3 through 6, the steam chamber 14 is formed between the soleplate 12, which may be cast from aluminum, and a steam chamber lid 50, which may comprise an aluminum plate. As is typical of iron soleplates, the soleplate 12 has a generally triangular shape, having a rearwardly convexly curved rear edge 54 and convexly curved side edges 56 that come to a rounded point 58 at its front end. The steam chamber 14 has an upstanding outer wall 60 of a triangular peripheral shape similar to the outer periphery of the soleplate 12. Outer wall 60 has an upwardly-open channel 62 along its entire length. The steam chamber lid 50 comprises a flat plate portion 64 bounded by a peripherally-extending skirt 66 that is shaped and sized to be inserted into the outer wall channel 62.

For purposes of holding the steam chamber lid 50 on the soleplate 12, cast as part of the soleplate 12 are plural upstanding rivet bosses 67 having reduced diameter heads that project through aligned apertures 68 in the soleplate lid 50. A thermostat boss 70 is also cast with the soleplate 12 and a hole 72 for receiving the upper end of the thermostat boss 70 is formed in the steam chamber lid 50. Also cast with the soleplate 12 are three large rivet bosses 74 having D-shaped heads which are adapted to hold connecting twist tabs 75 (FIGS. 2 and 8) used to affix the base cover 16 to the soleplate 12. The forwardmost large rivet boss 74 is located in the steam chamber 14 and a hole 76 therefor is provided in the lid 50.

In addition to the several bosses mentioned above, the soleplate 12 includes a blast path 80 defined by an upstanding outer rib 82 and an upstanding inner rib 84 that extends over a substantial portion of the length of the heating element 15. A surge of water can be pumped onto a portion of the soleplate 12 located between the outer rib 82 and the inner rib 84 and essentially directly over the U-shaped forward end of the heating element 15, the water being forced through a seal 86 (FIG. 2) located in a hole 88 in the lid 50 by operation of the piston 38.

A baffle 90 located at the rearward end of the steam chamber 14 has a concave front face spanning across substantially the entire rearward end of the steam chamber 14.

The blast path ribs 82 and 84, the baffle 90, and the raised portions of the soleplate 12 that accommodate the heating element effectively divide the steam chamber 14 into three sections, namely, the blast path 80, a central vaporization section 92, and an outer steam vent section 94. All of the steam vents 13 are located in the steam vent section. In the soleplate design illustrated in the drawings, there are four sets of steam vents 13, a set of rear vents in back of the rear baffle 90, two sets of side vents which are located outside the margins of the heating element 15 and the outer rib 82, and a set of front vents located between the nose of the outer rib 82 and the nose of the steam chamber 14.

For ordinary steam operation, water is introduced through the drip valve seal 35 into the front end of the vaporization section 92. As the water is vaporized to produce steam, the steam travels toward the back of the vaporization section 92 and follows a tortuous paths indicated by arrows in FIG. 5 around the baffle 90 to the rear steam vents 13 or around the rearward ends of the outer ribs 82 to the side and front vents 13. As explained above, the baffle 90 tends to direct vapor toward the center and the front of the vaporization section 92 so that water particles striking the baffle 90 will tend to accumulate and puddle in front of the baffle 90 and not reach the steam vent section 94.

When a blast of steam is produced by operation of the piston 38, the steam is formed along the length of the blast path 80 and exits the rearward end of the blast path 80 in a stream directed at the concave front face of the baffle 90. Accordingly, as with vapor created in the vaporization section 92, water particles that have not completely vaporized into steam will strike the baffle 90 and tend to accumulate in front of the baffle 90 and not enter into the steam vent section 94.

Figure 6:
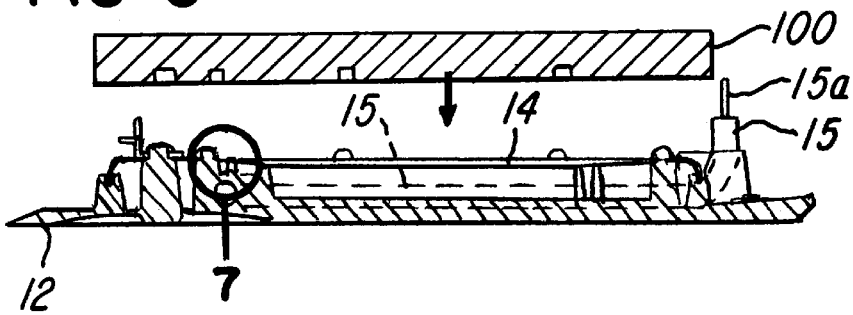
FIG. 6 is a cross-sectional view taken along line 6—6 of FIG. 5 and diagrammatically showing a press plate.
Figure 7:
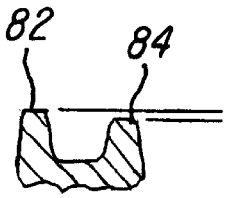
FIG. 7 is an enlarged cross-sectional view taken from the circle 7 of FIG. 6 of a blast path located in the steam chamber.

With reference to FIGS. 6 and 7, the outer blast path rib 82 and the baffle 90 are preferably at the same height relative to the bottom surface of the soleplate 12. In contrast, as shown best in FIG. 7, the inner blast path rib 84 is slightly lower than the outer blast path rib 82. For example, if the lid 50 is formed from a sheet of aluminum which is 0.025 inch thick, the inner blast path rib 84 may be on the order of 0.020 to 0.040 inch lower than the outer blast path rib 82.

Figure 4:
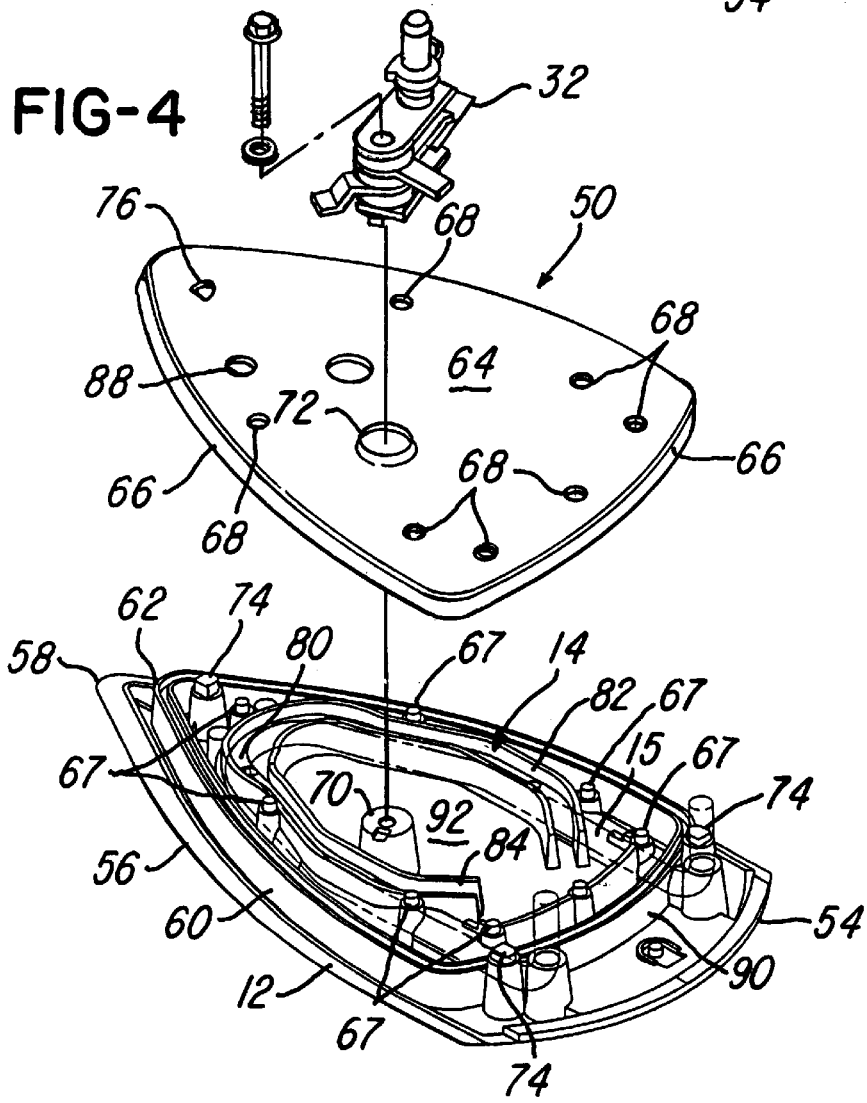
FIG. 4 is an exploded perspective view of the soleplate, including a heating element illustrated by phantom lines, the steam chamber lid, and a thermostat used to control the temperature of the heating element.
Figure 5:
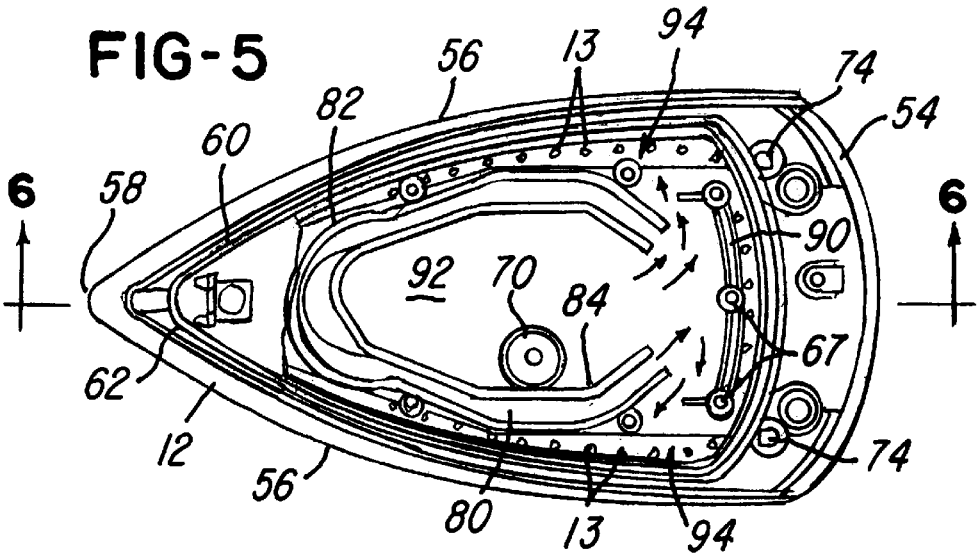
FIG. 5 is a top plan view of the soleplate.
Figure 8:
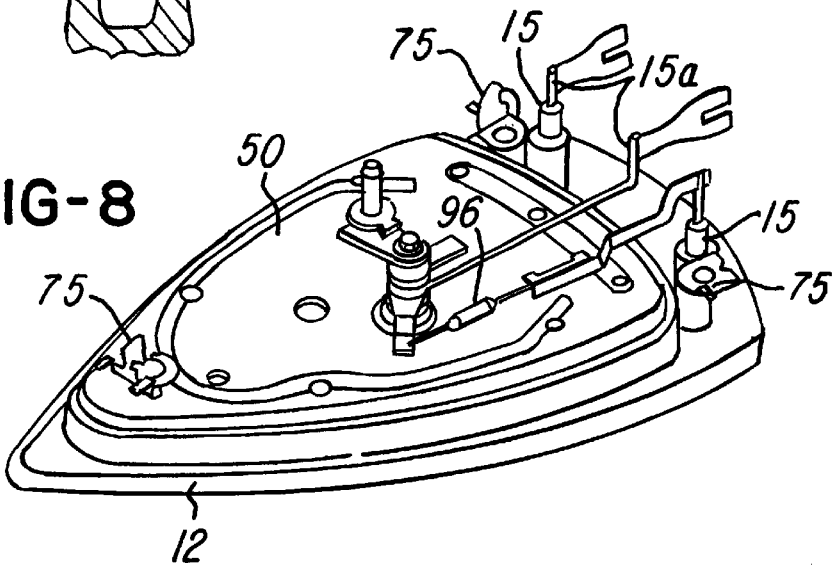
FIG. 8 is an isometric view of the soleplate and the steam chamber lid and showing a thermostat and electrical connections thereon.

During manufacture, the soleplate 12 is die cast to the desired shape and the lid 50, formed as illustrated in FIG. 4, assembled onto the soleplate 12 by first applying a sealant, such as RTV, into the soleplate's outer wall channel 62. The lid 50 is then assembled onto the soleplate 12 with the lower, outer, edge of the lid skirt 66 inserted into the channel 62. Thereafter, the lid 50 is pressed into sealing engagement with the top surfaces of the outer and inner blast path rib 82 and 84 and the baffle 90. As diagrammatically shown in FIG. 6, a press plate 100 having a flat pressure-applying lower surface provided with apertures to accommodate the various rivets or bosses can be used to create the sealing engagement of the lid 50 with the ribs 82 and 84 and the baffle 90. Preferably, sufficient pressure is applied to the lid 50 by the press plate 100 that impressions of the outer blast path rib 82 and the baffle 90 are visible in the top surface of the lid 50 as shown in FIG. 8. The rivets formed on the rivet bosses 67 are thereafter peened into engagement with the upper surface of the lid 50 to maintain the sealing engagement of the lid 50 to the soleplate 12 and the connecting tabs 75 connected to the bosses 74 by peening their rivet heads. Sealant is then applied over the rivet heads on top of the lid 50.

Figure 9:
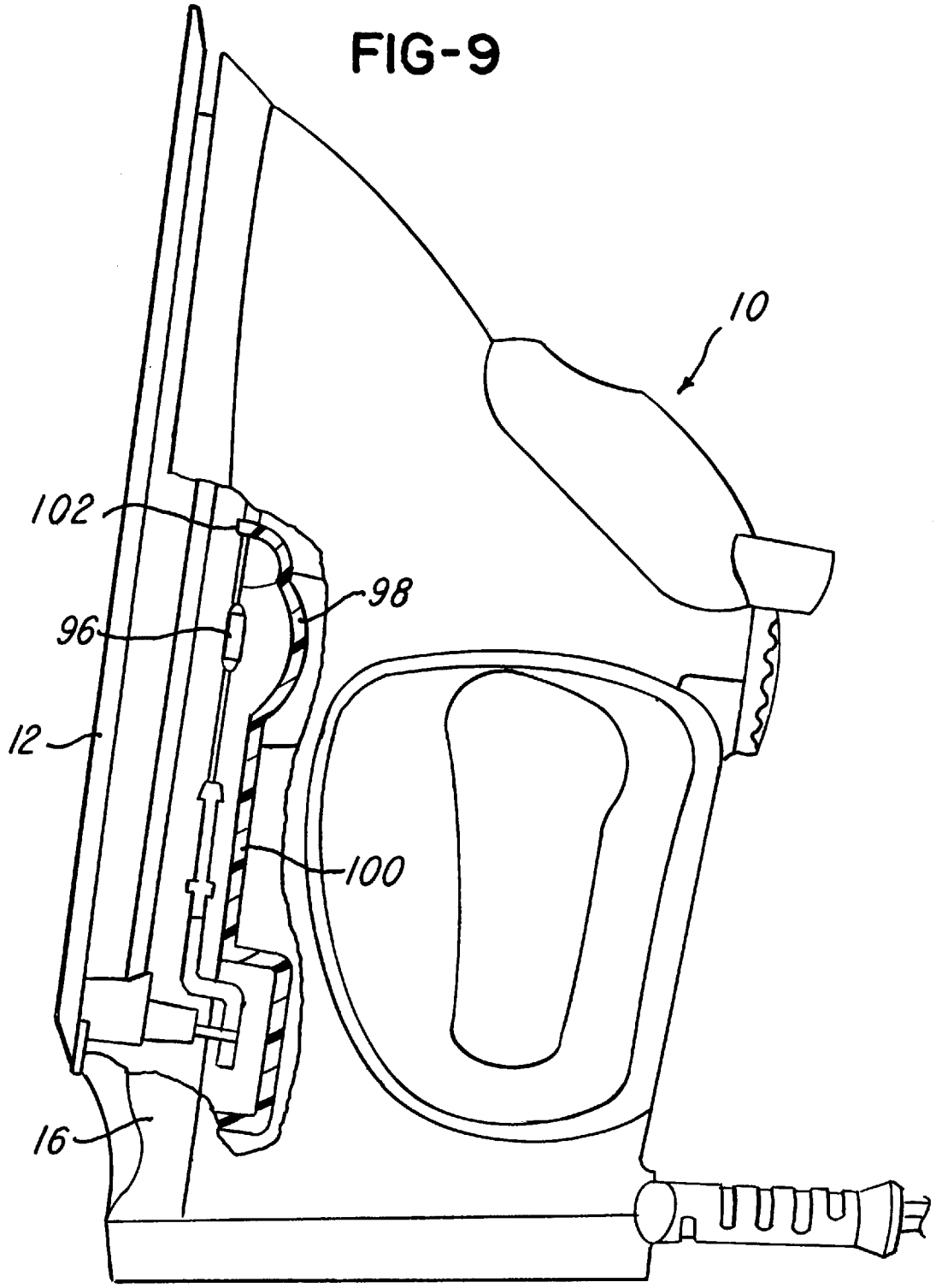
FIG. 9 is a simplified, side elevational view, with parts in cross section, of the steam iron of this invention shown resting upright on its rear cover.

With reference to FIGS. 2, 8, and 9, the electrical components for controlling the iron 10 include a TCO fuse 96 mounted between the soleplate 12 and the base cover 16. As well known in the art, the TCO 96 would open circuit the heating element 15 in the event of a thermal runaway condition. In accordance with this invention, the base cover 16 is formed to include a dome 98 overlying the TCO 96 that accumulates and retains, in the area around the TCO 96, heat created by the operation of the iron 10. Accordingly, the TCO 96 is exposed to heat conditions which, even when the iron is resting in an upright position as shown in FIG. 9, are highly representative of the heating of the soleplate 12. The provision of the dome 98 enables the use of a TCO 96 which will not open the heating element circuit unless a genuine thermal runaway condition is encountered.

The shape and size of the dome 98 should be determined by trial and error, however, the distance from the outer diameter of the TCO 96 to the inside crown of the dome 98 is preferrably in the range of 3 to 4 mm. With reference to iron 10 resting on its soleplate 12, rib 102 shown in FIG. 9 extends below the lowermost canister portion of TCO 96. Therefore, when the iron 10 is in its upright position as shown in FIG. 9, rib 102 assists dome 98 in accumulating and retaining heated air in the area around TCO 96, allowing TCO 96 to better sense the heat created by the operation of the iron 10.

In FIG. 2, it will be observed that the base cover 16 has a channel 100 extending from the rearward end of the iron 10 and leading to the dome 98. The channel 100 accommodates electrical connections to the TCO 96 and also provides a path for directing heated air to the dome 98. The channelling of heated air to the dome 98 increases the effectiveness of the dome 98 in causing the TCO 96 to respond quickly to thermal runaway conditions.

Although the presently preferred embodiment of this invention has been described, it will be understood that within the purview of the invention various changes may be made within the scope of the following claims.

Having thus described our invention, we claim:

1. In the manufacture of a steam iron having a steam chamber formed by a metal soleplate and a metal lid, the steam chamber including a blast path having an inner rib integral with the soleplate and an outer rib integral with the soleplate, the steps comprising: forming the outer rib to have a greater height than the inner rib, placing the lid over the soleplate in covering relation to said blast path and said inner and outer ribs, applying pressure to said metal lid by a press member having a planar lower surface facing the top surfaces of said inner and outer ribs so that said lid is sealed to both said inner rib and said outer rib.

2. The method of claim 1 wherein said step of applying pressure is continued until impressions from the outer blast rib are visible from the top surface of the lid.

3. The method of claim 1 further comprising the step of providing multiple rivets that project upwardly from the soleplate, forming the lid with openings that receive the rivets when the lid is placed over the soleplate, and peening the upper ends of the rivets over the upper surface of the lid to maintain the sealing engagement with said ribs and said lid.

4. The method of claim 3 wherein said soleplate has an upwardly projecting thermostat-supporting boss and an upwardly-open channel bounding said steam chamber and wherein said lid has a hole for receiving said boss and an outer edge substantially co-extensive in a horizontal plane with said channel, said method further comprising applying a sealant to said channel before placing said lid on said soleplate and inserting said outer edge into said channel when placing said lid over said soleplate, applying a sealant to said rivets after they are peened, and applying a sealant to the gap between the thermostat and the thermostat-receiving hole.

5. In a steam iron, a steam chamber formed from a soleplate and a steam chamber lid and having a blast path formed from an outer rib and an inner rib, said outer rib having a height greater than said inner rib, and said lid overlying and sealed to both said outer rib and said inner rib.

6. The steam chamber of claim 5 further comprising a baffle having a concave forwardly facing front surface spanning across a substantial portion of the rearward end of said steam chamber.

7. The steam chamber of claim 6 wherein said blast path has rearward open ends facing the front face of said baffle.

8. In an electric iron having a soleplate and a base cover and a TCO fuse located between the soleplate and the base cover, the improvement wherein the base cover has a dome covering the TCO fuse for accumulating and retaining heat in surrounding relation to the TCO fuse.

9. The improvement of claim 8 in which the inside crown of the dome is spaced from the outer diameter of the TCO fuse in the range of 3 to 4 mm.

10. The improvement of claim 8 in which the base cover has a channel for channelling heated air into the dome.

* * * * *